US009175936B1

(12) United States Patent
Collier

(10) Patent No.: US 9,175,936 B1
(45) Date of Patent: Nov. 3, 2015

(54) SWEPT CONICAL-LIKE PROFILE AXISYMMETRIC CIRCULAR LINEAR SHAPED CHARGE

(71) Applicant: Innovative Defense, LLC, Smithville, TX (US)

(72) Inventor: Nicholas Collier, Smithville, TX (US)

(73) Assignee: Innovative Defense, LLC, Smithville, TX (US)

( * ) Notice: Subject to any disclaimer, the term of this patent is extended or adjusted under 35 U.S.C. 154(b) by 149 days.

(21) Appl. No.: 14/181,223

(22) Filed: Feb. 14, 2014

Related U.S. Application Data

(60) Provisional application No. 61/765,656, filed on Feb. 15, 2013.

(51) Int. Cl.

| | |
|---|---|
| ***F42B 1/00*** | (2006.01) |
| ***F42B 1/028*** | (2006.01) |
| ***F42B 1/032*** | (2006.01) |
| ***F42B 1/036*** | (2006.01) |

(52) U.S. Cl.
CPC ..... *F42B 1/028* (2013.01); *F42B 1/032* (2013.01); *F42B 1/036* (2013.01)

(58) Field of Classification Search
CPC ..... F42B 1/028; F42B 1/032; F42B 1/036
USPC ..... 102/307
See application file for complete search history.

(56) References Cited

U.S. PATENT DOCUMENTS 2,757,611 A * 8/1956 Church ..... F42B 1/024 102/307
2,796,833 A * 6/1957 Sweetman ..... E21B 43/116 102/306
2,804,823 A 9/1957 Jablansky
3,302,567 A * 2/1967 Venghiattis ..... E21B 43/117 102/306
3,561,361 A 2/1971 Kessenich et al.
3,721,192 A 3/1973 McEwan et al.
3,838,644 A 10/1974 Prochnow et al.
3,903,803 A 9/1975 Losey
3,908,933 A 9/1975 Goss et al.
4,185,551 A * 1/1980 Drimmer et al. ..... F42B 22/42 102/307
4,300,453 A 11/1981 Bigler
4,313,380 A 2/1982 Martner et al.

(Continued)

FOREIGN PATENT DOCUMENTS

GB 2246621 5/1992

*Primary Examiner* — Samir Abdosh
(74) *Attorney, Agent, or Firm* — D. Scott Hemingway; Hemingway & Hansen, LLP

(57) ABSTRACT

A novel shaped charge device that produces a hollow cylindrical jet capable of creating a hole in a target larger than the overall diameter of the device. In the conical family of axisymmetric circular linear shaped charge liners (Conical, Tulip, and Trumpet), this novel swept conical-like profile shaped explosive device produces a large diameter stretching hollow cylindrical jet and corresponding slug. The hollow jet is formed by peripherally initiating a high explosive (HE) that collapses the circular linear liner into the hollow cylindrical jet. The precision of the circular simultaneous peripheral initiation of the HE billet is accomplished by the use of a novel Circular Precision Initiation Coupler (CPIC). This CPIC uses a single point initiation to create a simultaneous peripheral detonation of the HE billet that collapses and drives the swept liner into a high speed stretching hollow cylindrical projectile, or more commonly called a jet in the industry.

22 Claims, 3 Drawing Sheets

(56) References Cited

U.S. PATENT DOCUMENTS

| | | | | |
|---|---|---|---|---|
| 4,342,262 | A | 8/1982 | Romer et al. | |
| 4,425,850 | A | 1/1984 | Grossler | |
| 4,430,939 | A | 2/1984 | Harrold | |
| 4,441,428 | A | 4/1984 | Wilson | |
| 4,450,768 | A | 5/1984 | Bell | |
| 4,466,353 | A * | 8/1984 | Grace | F42B 1/02 102/307 |
| 4,551,287 | A | 11/1985 | Bethmann | |
| 4,632,036 | A | 12/1986 | Ringel | |
| 4,643,097 | A | 2/1987 | Chawla et al. | |
| 4,665,826 | A | 5/1987 | Marer | |
| 4,669,386 | A | 6/1987 | Precoul et al. | |
| 4,672,896 | A | 6/1987 | Precoul et al. | |
| 4,688,486 | A | 8/1987 | Hall et al. | |
| 4,759,886 | A | 7/1988 | Daugherity | |
| 4,833,994 | A | 5/1989 | Strobush | |
| 4,841,864 | A | 6/1989 | Grace | |
| 4,896,609 | A | 1/1990 | Betts et al. | |
| 4,989,517 | A | 2/1991 | Adimari et al. | |
| 5,003,884 | A | 4/1991 | Nissl et al. | |
| 5,078,069 | A | 1/1992 | August et al. | |
| 5,088,416 | A | 2/1992 | Sabranski | |
| 5,235,128 | A | 8/1993 | Hardesty et al. | |
| 5,245,927 | A | 9/1993 | Ranes | |
| 5,251,561 | A | 10/1993 | Murphy | |
| 5,269,223 | A | 12/1993 | Mattsson et al. | |
| 5,320,044 | A | 6/1994 | Walters | |
| 5,621,185 | A | 4/1997 | Spengler et al. | |
| 5,753,850 | A * | 5/1998 | Chawla et al. | F42B 1/02 102/307 |
| 5,847,312 | A | 12/1998 | Walters et al. | |
| 5,988,071 | A | 11/1999 | Taylor | |
| 6,179,944 | B1 | 1/2001 | Monolo et al. | |
| 6,354,219 | B1 | 3/2002 | Pratt et al. | |
| 6,443,068 | B1 | 9/2002 | Meister | |
| 6,477,959 | B1 | 11/2002 | Ritman et al. | |
| 6,644,205 | B2 | 11/2003 | Ritman et al. | |
| 6,668,726 | B2 | 12/2003 | Lussier | |
| 6,758,143 | B2 | 7/2004 | Ritman et al. | |
| 6,792,866 | B2 | 9/2004 | Grattan | |
| 6,840,178 | B2 | 1/2005 | Collins et al. | |
| 7,261,036 | B2 | 8/2007 | Bourne et al. | |
| 7,621,221 | B2 | 11/2009 | Ritman | |
| 7,753,850 | B2 | 7/2010 | Averkiou et al. | |
| 7,779,760 | B2 | 8/2010 | Konig | |
| 7,810,431 | B2 | 10/2010 | Heine et al. | |
| 7,819,064 | B2 | 10/2010 | Saenger et al. | |
| 8,375,859 | B2 | 2/2013 | Sagebiel | |
| 2003/0183113 | A1 * | 10/2003 | Barlow et al. | F42B 1/028 102/476 |
| 2005/0188878 | A1 | 9/2005 | Baker et al. | |
| 2006/0107862 | A1 | 5/2006 | Davis et al. | |
| 2008/0011179 | A1 | 1/2008 | Michel et al. | |
| 2008/0134925 | A1 | 6/2008 | Konig | |
| 2008/0289529 | A1 | 11/2008 | Schilling | |
| 2009/0211481 | A1 | 8/2009 | Schwantes et al. | |
| 2011/0232519 | A1 | 9/2011 | Sagebiel | |
| 2013/0199394 | A1 | 8/2013 | Collier | |

* cited by examiner

SWEPT CONICAL-LIKE PROFILE AXISYMMETRIC CIRCULAR LINEAR SHAPED CHARGE

RELATED APPLICATION DATA

This application is a non-provisional application which claims the benefit of U.S. Provisional Application No. 61/765,656, filed Feb. 15, 2013.

TECHNICAL FIELD OF INVENTION

This invention relates to shaped charges and in particular to a swept conical-like profile shaped explosive device that produces a full caliber or greater hole, that is to say a hole as large as the explosive charge diameter (CD).

BACKGROUND OF THE INVENTION

Shaped charges come in many sizes and shapes and are used mainly for military weaponry and oil well perforating; to a lesser extent demolition and rescue are also users of this complex technology.

The concept of shaping an explosive charge, in order to focus its energy was known in 1792. ("The History of Shaped Charges" Donald R Kennedy)

In 1884 Max von Foerster conducted experiments in Germany showing that a hollow cavity explosive charge will focus the explosive energy and produce a collimated jet of high speed gasses along the longitudinal axis of the cavity, this jet also could penetrate steel.

In 1888, while conducting research for the U.S Navy, at Newport R.I., Charles Munroe discovered that not only could explosive energy be focused, but lining the hollow cavity in the explosive with metal increased the penetration dramatically, the effect is commonly called the Munroe effect.

These discoveries were further studied in 1910 by Egon Neumann of Germany who conducted similar experiment's, which showed that a cylinder of explosive with a metal lined conical hollow cavity could penetrate through steel plates. The military implications of this phenomenon were not realized until the lead up to world war two.

In the 1930's flash x-ray technology was developed which allowed the in depth study of the Shaped Charge jetting process. With this new and other diagnostics, it was possible to take XRay pictures of the collapse of the liner and the resulting jet. This led to a more scientific and complete understanding of the Munroe principle and emphasized the power of shaped charges.

Modern shaped charges as used in anti-tank weapons produce a long stretching rod like metal jet that penetrates about 5 to 8 charge diameters in steel, deeper in masonry or rock. The average diameter of a 5 CD through hole in steel from these charges is less than 15% of the explosive charge diameter (CD) of the device. The holes made by these jets do not provide sufficient diameter to allow follow on or follow through devices to pass into the perforation and add to the hole depth.

There have been some specialized efforts by Haliburton to produce other than conical type shaped charges for special purposes such as pipe cutting and anchor chain cutting. These types of charges are called linear shaped charges and use the two dimensional collapse to produce a thin sheet like jet with somewhat similar cutting power to the usual conical shaped charge. These linear shaped charges are flexible and can be formed by hand into desired shapes. The British Wall AXE circa 1960 is an example of a formable linear shape charge with a wide angle liner; the device is used against light structures such as wooden doors and thin walls and does not give very deep penetration.

Patent Application US2011/0232519 A1 by Erick J. Sagebiel discloses a diverging jet. The Sagebiel design is limited to a diverging jet trajectory of 1 to 45 degrees relative to the device axis of symmetry and produces a circular cookie cutter cut in a finite target leaving a center plug of material in the target.

The Sagebiel device contains a core plug that Sagebiel teaches could be used as a projectile to impact the annular ring cut pattern of a finite target.

The Sagebiel device is basically a symmetrical linear shaped charge device that has been formed into a circle around a symmetrical axis with planar, frusto-conical liner walls, which explains why it produces a round cookie cutter cut leaving behind a center core of the target material. Since Sagebiel's device is designed symmetrically like linear shaped charge it does not offer a solution for matching the momentums of the radially converging and diverging liner walls by balancing the liner wall masses and the amount of HE driving each wall. It does not teach the directional varying of the inner and outer wall thicknesses to compensate for the volume and mass differences, of the outside and inside liner walls, due to the vastly differing diameters in relation to the axis of symmetry.

Throughout the history of shaped charges the primary effort of research in this field was directed toward depth of penetration by the jet. Although hole size is worth considering, little research has been done on significantly increasing jet diameter and cross-sectional shape of the jet to produce a larger hole diameter. In oil field applications a larger hole is most desirable as the flow area of the hole increases rapidly with an increase in hole diameter. With the ability to produce a full caliber hole, a follow on or follow through device can be deployed into the hole to the correct standoff from the bottom of the hole. When detonated at the correct standoff this will increase the hole depth by that of the primary hole producing device, this can be repeated numerous times in the same hole.

SUMMARY OF INVENTION

The swept profile designs of the swept conical-like profile axisymmetric circular linear shaped charge (ACLSC) will efficiently remove more target material than a rod producing shaped charge. This increase in efficiency is achieved by making a much larger diameter jet. To produce a significantly larger jet one must consider focusing the energy of the jetting liner in a much larger pattern than that of a conventional shaped charge. This large diameter jet is achieved by detonating the high explosive (HE) billet, which is a mass of high explosive, thereby forming the swept liner profile into a stretching hollow cylindrical jet. This jet being close to the same diameter as the device forms a hole larger than the device diameter and removes the full device diameter of the target material.

In the conical family of ACLSC liners (Conical, Tulip, and Trumpet) this novel swept profile shaped explosive device produces a stretching hollow cylindrical jet and corresponding slug. The precision of the circular simultaneous initiation of the HE billet is accomplished by the use of a novel Circular Precision Initiation Coupler (CPIC). This CPIC uses a single point initiation to create a simultaneous peripheral detonation of the HE billet that collapses and drives the swept liner into a high speed stretching hollow cylindrical projectile, or more commonly called a jet in the industry.

BRIEF DESCRIPTION OF THE DRAWINGS

Because of the complexity of shapes involved, the inventor will use descriptive drawings and text to describe the device and how it functions.

DETAILED DESCRIPTION

Figure 1:
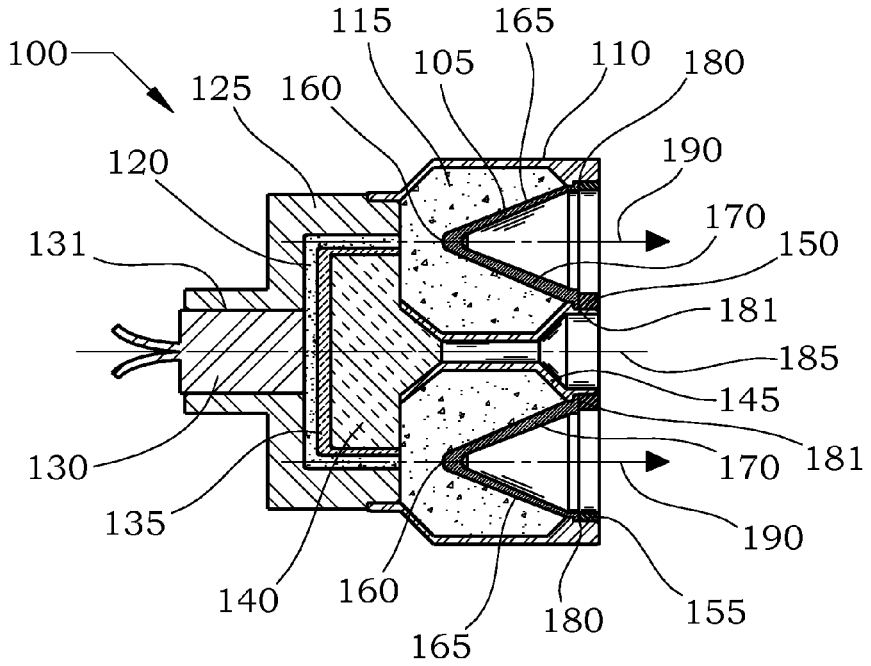
FIG. 1 is a cross-sectional view of a swept conical shaped charge device (SCSC).

This novel swept conical profile axisymmetric circular linear shaped charge (ACLSC) differs from a conventional lined shaped charge device, in that the ACLSC produces a large diameter hollow cylindrical jet as opposed to a rod like jet from a conventional lined shaped charge. This large diameter hollow jet will produce a full caliber or greater sized hole. This full caliber hole capability allows for a follow on or follow through devices of equivalent diameter to be placed at the correct standoff, in the hole produced by first said device. The ability to place secondary and tertiary devices in said hole allows the hole to be increased in depth with each device detonation in an infinite target. The uses and advantages of this innovation in shaped charge design are many in both military and commercial applications.

The swept profile designs of the swept conical-like profile axisymmetric circular linear shaped charge (ACLSC) will efficiently remove more target material than a rod producing shaped charge. This increase in efficiency is achieved by making a much larger diameter jet. To produce a significantly larger jet one must consider focusing the energy of the jetting liner in a much larger pattern than that of a conventional shaped charge. This large diameter jet is achieved by detonating the high explosive (HE) billet, which is a mass of high explosive, thereby forming the swept liner profile into a stretching hollow cylindrical jet. This jet being close to the same diameter as the device forms a hole larger than the device diameter and removes the full device diameter of the target material.

The ACLSC device produces a parallel, converging, or diverging jet relative to the axis of symmetry, and is capable of removing the full diameter of material without leaving a center plug of target material to an infinite depth by the repeated use of follow on devices.

The swept profile liner configurations included in this invention are the Conical, Tulip, and Trumpet profiles. These liner profile names represent the two dimensional (2D) geometrical profiles that would be seen if a hollow half toroid of said shape were cut sagittal along its longitudinal axis. This profile is swept about the central axis of the device creating the hollow half toroid shape or trough liner consisting of an inner and outer diameter providing a through hole in the center of the liner. The center through hole of the liner provides space for a central body, explosive shock wave attenuation materials, the escape of expanding gasses and the addition of a secondary projectile producing device. A hollow or solid central body will provide the inner HE billet containment surface, the inner liner wall mounting surface, a space for wave attenuation materials, the addition of a central secondary projectile producing device, and the escape path of inner expanding gases.

This invention should not be limited to these conical-like liner designs or profiles only; many other swept conical-like liner geometries can be incorporated, without changing the novelty of the device.

To simplify the description of the geometry, detonation and collapse of an ACLSC liner, we could look only at the 2D profile of the swept liner shape and other device components as if the charge was cut sagittal through the symmetrical axis. This cut will show the liner profile that makes the hollow toroid with an inner and outer wall joined by an apex at the collapse axis. The collapse axis that passes through the apex of the liner profile is visually an axis when viewed in 2D, but in reality it is not a true axis. If viewed in three dimensional (3D) space this collapse axis would be seen as a hollow cylinder with a diameter equal to the apex diameter of the liner extending through the device and coaxial to the device axis of symmetry. For easy of discussion the 2D term collapse axis will be used to describe the 3D hollow cylinder that the liner collapses on.

In the conical family of ACLSC liners (Conical, Tulip, and Trumpet), this novel swept profile shaped explosive device produces a stretching hollow cylindrical jet and corresponding slug. The aforementioned jet is formed by the extremely high pressures created by the detonation of an HE billet, which is a mass of high explosive. This HE billet is initiated in a circular pattern at the aft end of the HE billet and at the exact diameter of the apex of the swept liner profile. The precision of the circular simultaneous initiation of the HE billet is accomplished by the use of a novel Circular Precision Initiation Coupler (CPIC). This CPIC uses a single point initiation to create a simultaneous peripheral detonation of the HE billet that collapses and drives the swept liner into a high speed stretching hollow cylindrical projectile, or more commonly called a jet in the industry. The CPIC can be used with many swept liner geometries, and tailored to the desired size and shape required.

Although the ACLSC charge will not penetrate as deep as a conventional shaped charge, it will remove a full charge diameter of material, which allows the ACLSC to remove far more material volume than a much deeper penetrating conventional shaped charge device.

Since ACLSC devices produce, full caliber holes it is possible to send follow on charges into the penetration deepening the hole and sending the debris out of the hole at ½ the velocity of the penetrating jet. Follow on charges are not possible with traditional shaped charges since the penetration hole is very much smaller than the charge diameter which prevents the next charge from obtaining the correct standoff from the bottom of the hole. Oil and gas well completions and military users will benefit greatly from the use of ACLSC devices which is the goal of this shaped charge concept and development.

Liner thickness of shaped charges are dependent on the overall diameter of the device, the liner wall should increase in thickness as the device diameter increases and decrease in thickness as the device diameter decreases. Shaped charges scale very nicely and for the person skilled in this craft making this device in any size would be evident based on the information given. Shaped charges by their very nature have varying wall thicknesses and profiles depending on material, density, and desired effect on a target.

Preferably the liner uses a copper material, but liners may be made from most any metal, ceramic, powdered metals, tungsten, silver, copper or combination of many materials.

Initiation of a swept profile shaped charge detonation requires a two stage initiation process that accurately aligns the detonation wave with the chosen swept liner design. This accuracy is obtained by first coupling a single point detonation from a detonator that initiates the CPIC high explosive (HE) that is in the shape of a shallow circular cup which forms a non-broken simultaneous ring detonation. During the second stage of initiation the simultaneous detonation ring from the CPIC HE initiates detonation at the aft end of the main HE billet. The diameter of the ring initiation of the main HE billet is critical to obtain the desired direction of j et projection and must be tailored to each liner design.

As the ring detonation wave travels through the HE billet, the pressures created on the swept liner walls cause them to collapse and converge onto a collapse axis forming the hollow cylindrical jet wall. As this process continues, the jetting material forms a stretching hollow cylinder jet with its median diameter equal to the diameter of the apex of the swept profile liner cavity.

Detonation wave control is very important to form stable jetting from shaped charges. Reflected shock waves can negatively affect jet formation and the overall performance of the shape charge. The ACLSC design in this embodiment has various features incorporated into it to minimize and redirect reflected shock waves. One method of control is using a central column made from a low sound velocity material that serves as a shock wave dampener or attenuator. The design of the outer and inner HE billet containment bodies including shape, material type (i.e., powdered metal) and thickness, will both have specific designs to minimize reflected shock waves that would return and disturb jet formation. The ACLSC devices can use cast, pressed, extruded, or even hand packed HE from any high quality explosive that is capable of 4-10 km/s detonation rate.

In order to take advantage of the penetrating power of a swept profile shaped charge to produce a full caliber hole, it is necessary to concentrate the energy of the jetting material in a different pattern than that of a conventional shaped charge, such as spreading the energy into a large diameter circle, thus the need for a circular linear swept profile design. There are many difficulties with spreading the energy of a shaped charge in order to achieve a full caliber hole. Conventional cone lined shaped charges collapse and converge its liner material to a centrally located symmetrical axis, whereas the material of a swept profile lined shaped charge liner has to converge and diverge at the same time to a collapse axis of greater diameter than a central symmetrical axis. Timing and momentum balancing of the converging and diverging liner material is critical for jet creation and stability. If the swept liner wall thickness and the amount of explosive used are not correctly matched for the application it will result in an under driven or over driven liner, neither event will produce proper jetting. Adequate charge to mass ratios of explosive to liner as per Gurney equations should be adhered to as close as the application size restrictions will allow to prevent underdriving or overdriving the liner.

Herein disclosed is an axisymmetric circular linear shaped charge device. The shaped charge device has a liner configured in a partial toroid with a longitudinal axis intersecting an aperture located near the center of the partial toroid. The partial toroid being open-ended on a plane that intersects the longitudinal axis in a perpendicular manner toward a front end of the shaped charge device. The liner having a hollow conical cross-section extending toward a closed end of the partial toroid as defined by a longitudinal plane that is aligned on the longitudinal axis and an apex of the conical cross-section at a closed end of the partial toroid that extends toward a rear end of the shaped charge device. The liner having an outer surface and an inner surface with the inner surface exposed toward the open end of the front end of the shaped charge device and the liner producing an explosive hollow cylindrical jet stream directed toward the front of the shaped charge device upon detonation of the shaped charge device.

A billet of high explosive material having a front end and a rear end located behind and proximate to the outer surface of the liner and configured as a toroid with an internal aperture located proximate to the aperture of the liner. The billet producing a high explosive detonation effect applied to the liner to produce the hollow cylindrical jet stream. A coupler located in a rear portion of the shaped charge device and coupled to the rear end of the billet and the coupler producing a detonation wave initiating the high explosive detonation effect of the billet.

A body located around the outer surface of the billet and extending longitudinally the length of the billet. The body having a front end secured to the liner and a rear end secured to the coupler. An attenuator located proximate to the aperture in the billet that dampens a detonation wave. A center body located proximate to the aperture of the liner and rearward of the billet toward the rear portion of the shaped charge device.

Herein disclosed is a method of producing an axisymmetric cylindrical jet stream from a circular linear shaped charge device by providing a liner configured in a partial toroid with a longitudinal axis intersecting an aperture located near the center of the partial toroid. The partial toroid being open-ended on a plane that intersects the longitudinal axis in a perpendicular manner toward a front end of the shaped charge device. The liner having a hollow conical cross-section extending toward a closed end of the partial toroid as defined by a longitudinal plane that is aligned on the longitudinal axis and an apex of the conical cross-section at a closed end of the partial toroid that extends toward a rear end of the shaped charge device. The liner having an outer surface and an inner surface with the inner surface exposed toward the open end of the front end of the shaped charge device.

Positioning a billet of high explosive material behind and proximate to the outer surface of the liner and proximate to the aperture of the liner. The billet producing a high explosive detonation effect applied to the liner to produce the hollow cylindrical jet stream. Positioning a coupler at a rear portion of the shaped charge device in contact with the rear of the billet. The coupler producing a detonation wave and initiating the high explosive detonation effect of the billet.

Surrounding the shaped charge device with a body around the outer diameter of the billet and extending longitudinally the length of the billet. Producing an explosive hollow cylindrical jet stream with the liner that is directed toward the front of the shaped charge device upon detonation of the shaped charge device.

Additionally you can provide an attenuator proximate to the aperture in the billet that dampens a detonation wave. Positioning a center body proximate to the aperture of the liner and rearward of the billet toward the rear portion of the shaped charge device.

Three conical-like designs using the circular linear concept will be described here: the swept conical profile design, the swept tulip profile design, and the converging swept conical profile design, though many other shapes are possible within the conical family.

The swept conical shaped charge device (SCSC) 100, having an aft area and a fore area, is shown in FIG. 1 and consists of a swept conical profile (SCP) liner 105, a body 110, a high explosive (HE) billet 115 which is a mass of high explosive, a Circular Precision Initiation Coupler (CPIC), an explosive shock attenuator (ESA) 140, a center body 145, an inner retaining ring 150, and an outer retaining ring 155. All components of device 100 share a common symmetrical axis 185.

The SCP liner 105 is the working material of the shaped charge and is located about the fore area of the SCSC. Preferably the liner uses a copper material, but liners may be made from most any metal, ceramic, powdered metals, tungsten, silver, copper or combination of many materials.

Figure 1A:
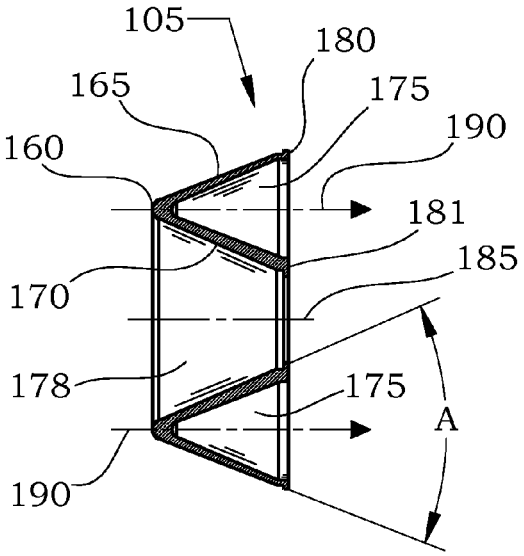
FIG. 1A is a cross-sectional view of a swept conical profile (SCP) liner

The SCP liner 105, as singularly shown in FIG. 1A, has an inside wall 170, an outside wall 165, an apex 160 an outer base end 180, an inner base end 181, an outer surface 178, an inner surface 175, and an included angle A. For a 5 inch diameter liner of the SCSC, the inside wall 170 needs to be between 1-3 mm at the apex 160 and taper toward the inner base end 181 to between 2-5 mm. The outside wall 165 must taper the reverse direction from between 1.5-3 mm at the apex 160 and tapering down to between 1-2.5 mm at the outer base end 180. These dimensions will be refined with numerical code and experiment to give the most tailored jet to address the specific target material. Included angles for attaining the Munroe effect from two colliding walls ranges from 36 to 120 degrees. The jet velocity achieved from a shaped charge is dependent on the included angle of the liner; the narrower the angle the faster the jet but the lower the jet mass. A zero included angle (i.e., cylinder liner) can be made to jet but the jet mass is so low, the efficiency is reduced. Jet velocities can vary from 4 to 10 km/s depending on the liner material, included angle, wall thickness and other geometries.

The HE billet 115, located about the outer surface of the SCP liner 105, provides the energy to collapse the SCP liner 105, increases the ductility of the SCP liner 105, and focuses the flowing material causing it to jet in the shape of a hollow cylinder at very high velocity. The SCSC body 110 provides an outer mounting surface for the SCP liner 105 which is held to body 110 by outer retaining ring 155 about the outer base end 180. Body 110 also serves as a containment vessel for the delicate HE billet 115 and protects from damage or impact by supporting the outer diameter of HE billet 115. Body 110 can provide tamping for the HE billet 115 depending on body 110 thickness and density. The outer diameter of the HE billet 115 can range from about 0-25% of liner outer diameter larger than the SCP liner 105 outer diameter and still produce a proper jet. The inner diameter of the HE billet 115 can range from about 0-25% of liner inner diameter smaller than the SCP liner 105 inner diameter and still produce a proper jet. If the swept liner wall thickness and the amount of HE used are not correctly matched for the application it will result in an under driven or over driven liner, neither event will produce proper jetting. Adequate charge to mass ratios of HE to liner as per Gurney equations should be adhered to as close as the application size restrictions will allow to prevent underdriving or overdriving the liner.

The CPIC, located in the aft area of the SCSC, consists of a CPIC HE 120, charge cover 125, detonator 130, and CPIC HE cover 135. Detonator 130, located about the aft of the CPIC, provides the initial detonation impulse to the shallow cup shaped CPIC HE 120. Charge cover 125 provides a mounting cavity 131 for detonator 130 and CPIC HE 120, and provides the critical alignment of detonator 130 with CPIC HE 120 on the symmetrical axis 185. Charge cover 125 also provides the critical alignment of CPIC HE 120 with HE billet 115, which allows for a precise ring initiation of HE billet 115. Charge cover 125 also serves to cover and protect the aft side of the HE billet 115 and maintains intimate contact of CPIC HE 120 with the HE billet 115. The CPIC function is to transform a single point initiation from detonator 130 into a ring detonation of the CPIC HE 120 that will ring initiate the aft end of the HE billet 115 which is precisely aligned with the collapse axis 190 and apex of SCP liner 105. The CPIC HE cover 135 provides a stable platform for the CPIC HE 120, houses the ESA 140, and provides a mounting structure to the aft end of the center body 145.

The ESA 140 is made from a low sound velocity material and serves as a detonation wave dampener. Center body 145 supports the inner diameter of HE billet 115 and provides space for ESA 140, a path for escaping detonation gases, and other devices (i.e., secondary projectile forming devices). Center body 145 provides an inner mounting surface for SCP liner 105 and aligns it with symmetrical axis 185. SCP liner 105 is held to center body 145 by inner retaining ring 150 about the liner inner base end 181. Device 100 is capable of producing a hollow cylindrical jet from the SCP liner 105, said jet will produce a full device diameter hole or larger in the target.

The center body 145 is encompassed by the explosive charge or main high explosive (HE) billet and can be solid or hollow. The hollow center body 145 being an essential part of the swept profile design could contain shock attenuation materials used to dampen, reflect, and absorb shock waves that would have a detrimental effect on the formation of a stable jet. The hollow center body 145 space can also be used to contain a center projectile producing device or for adjusting HE billet quantity driving the inside wall of the liner, in addition the space can be used to relieve pressure from expanding gasses from the detonation of the HE.

Detonation wave control is very important to form stable jetting from shaped charges. Reflected shock waves can negatively affect jet formation and the overall performance of the shape charge.

The SCSC design in this embodiment has various features incorporated into it to minimize and redirect reflected shock waves. One method of control is using a hollow center body 145 that incorporates an ESA 140 made from a low sound velocity material that serves as a shock wave dampener or attenuator. The design of the outer and inner HE billet containment bodies (body 110 and center body 145) including shape, material type (i.e., powdered metal) and thickness, will both have specific designs to minimize reflected shock waves that would return and disturb jet formation. The SCSC devices can use cast, pressed, extruded, or even hand packed HE from any high quality explosive that is capable of 4-10 km/s detonation rate.

Initiation of a SCSC detonation requires a two stage initiation process that accurately aligns the detonation wave with the SCP liner 105. This accuracy is obtained by first coupling a single point detonation from a detonator that initiates the CPIC HE 120 that is in the shape of a shallow circular cup which forms a non-broken simultaneous ring detonation. During the second stage of initiation, the simultaneous detonation ring from the CPIC HE 120 initiates detonation at the aft end of the main HE billet 115. The diameter of the ring initiation of the main HE billet 115 is critical to obtain the desired direction of jet projection and must be tailored to each liner design.

As the ring detonation wave travels through the HE billet 115, the pressures created on the liner walls (165 and 170)

cause them to collapse and converge onto a collapse axis 190 forming the hollow cylindrical jet wall. As this process continues, the jetting material forms a stretching hollow cylinder jet with its median diameter equal to the diameter of the apex of the SCP liner 105.

FIG. 1A shows SCP liner 105 that is used in device 100 of FIG. 1. The SCP liner 105 consist of an outer base end 180, outside wall 165, apex 160, inner base end 181, inside wall 170, axis of symmetry 185, collapse axis 190, an outer surface 178, an inner surface 175, and included angle A. Collapse axis 190 is shown parallel to the axis of symmetry 185, but can be almost any angle relative to the axis of symmetry 185 that would represent a converging or diverging jet trajectory formed by the detonation wave and SCP liner 105. The thickness of inside wall 170 gradually increases from the apex 160 to the inner base end 181, and the thickness of outside wall 165 gradually decreases from apex 160 to the outer base end 180. The wall thickness is varied in this way to balance the explosive charge to SCP liner 105 mass ratios, which also balances the momentum of the collapse of the SCP liner 105 walls. Liner wall momentum balancing will insure that inside wall 170 and outside wall 165 will meet at the collapse axis 190 in concert to produce stable jetting. SCP liners can be challenging to balance since the mass of the outer wall 170 increases as the diameter increases from apex 160 to base end 180 and the mass of the inner wall 165 decreases as the diameter decreases from apex 160 to base end 181.

Liner thickness of shaped charges are dependent on the overall diameter of the device, the liner wall should increase in thickness as the device diameter increases and decrease in thickness as the device diameter decreases. Shaped charges scale very nicely and for the person skilled in this craft making this device in any size would be evident based on the information given. Shaped charges by their very nature have varying wall thicknesses and profiles depending on material, density, and desired effect on a target.

For example, a 5 inch diameter liner of the SCSC the inside wall needs to be between 1-3 mm at the apex and taper toward the base end to between 2-5 mm. The outside wall must taper the reverse direction from between 1.5-3 mm at the apex and tapering down to between 1-2.5 mm at the base. These dimensions will be refined with numerical code and experiment to give the most tailored jet to address the specific target material.

The outside wall 165 and inside wall 170 of SCP liner 105 are set at an included angle A that can be changed to produce desired jetting characteristics (i.e., jet mass, and velocity). SCP liners require approximately a 30-120 degree included angle A between the outside wall 165 and inside wall 170 for optimum jetting. Greater included angles shorten the length of the SCP liner 105 along the axis of symmetry and shortens the length of the inside wall 170 and outside wall 165, this shortening forces the diameter and mass of the outside wall 165 to increase at a higher rate from apex 160 to outer base end 180, inversely the inside wall 170 decreases at a higher rate in diameter and mass from apex 160 to inner base end 181. The included angle A and mass distribution of the inside wall 170 and outside wall 165 must be tailored to each other to produce a straight axisymmetric hollow cylindrical jet on collapse axis 190, that projects in the direction of the collapse axis 190 arrow and is parallel with symmetrical axis 185 of the SCP liner 105.

Detonation pressures from the high explosive collapse the SCP liner 105 outside wall 165 moving it into a smaller volume thusly increasing its bulk density and velocity, while being driven toward the collapse axis 190. At the same time the SCP liner 105 inside wall 170 is driven toward the collapse axis 190 by the high explosive; the inside wall 170 driven material is moved, decreasing in bulk density and velocity due to an increase in diameter as it moves toward the collapse axis 190. This process further explains the important and tedious task of momentum balancing the high velocity collapsing SCP liner 105 walls in order to produce a viable hollow cylindrical jet.

Figure 1B:
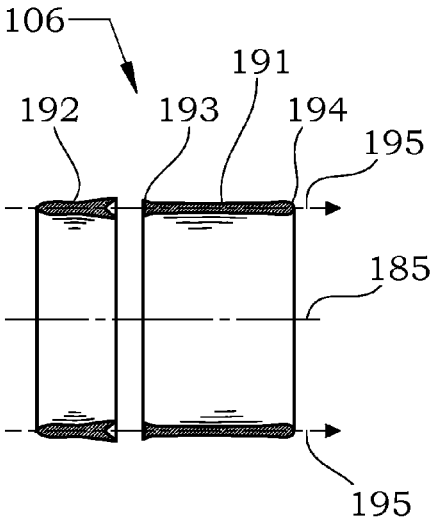
FIG. 1B is a cross-sectional view of a jet formed from an SCSC liner.

FIG. 1B is a cross-sectional view of a typical hollow cylindrical projectile (HCP) 106 produced by a SCSC. The HCP 106 consists of a jet 191, slug 192, jet tail 193, jet tip 194, projection axis 195, and symmetrical axis 185. Jet 191 and slug 192 velocities, angle of projection, thickness, length and inside diameter can vary depending on the design of the SCSC. This depiction of HCP 106 is at a finite time after the detonation of a SCSC. The HCP 106 at an earlier time frame after detonation would show the jet 191 and slug 192 shorter in length and possible still connected. At a later time frame, jet 191 and slug 192 would become longer, thinner and further separated because of the ductile stretching of the HCP material. The projection axis 195 is shown parallel to symmetrical axis 185 but could be almost any angle either converging or diverging depending on the SCSC design and intended use.

The SCSC is balancing the momentums of the collapsing inner 170 and outer 165 liner walls producing a large diameter stable projectile that will remove the full diameter of target material creating a hole without leaving behind a center core. If the momentums of a SCSC are not matched correctly, the jet will not follow the desired trajectory, be of insufficient mass for desired target penetration or not form at all.

Figure 2:
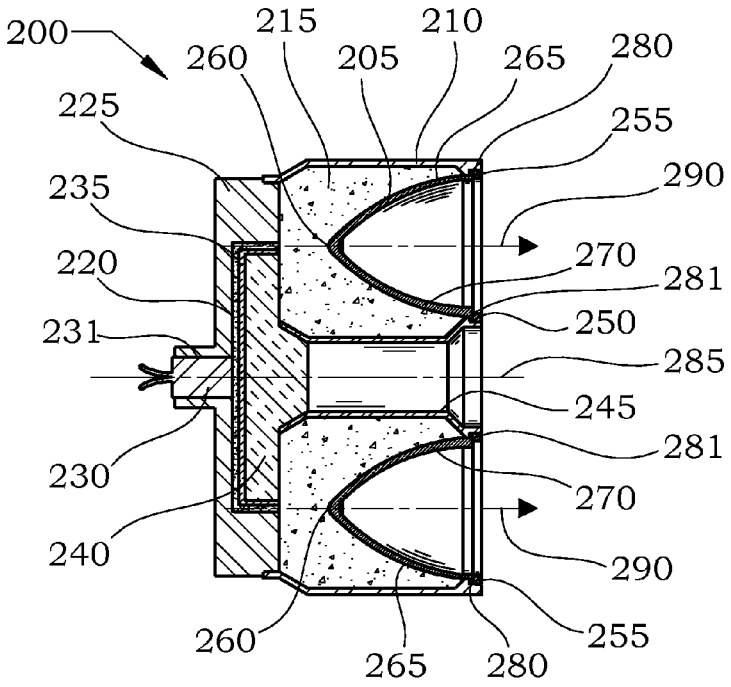
FIG. 2 is a cross-sectional view of a swept tulip shaped charge device (STUSC).

The swept tulip shaped charge device (STUSC) 200, having an aft area and a fore area, is shown in FIG. 2 and consists of a STUP liner 205, a body 210, a high explosive (HE) billet 215 which is a mass of high explosive, a Circular Precision Initiation Coupler (CPIC) HE 220, an explosive shock attenuator (ESA) 240, a center body 245, an inner retaining ring 250, and an outer retaining ring 255. All components of device 200 share a common symmetrical axis 285.

The STUP liner 205 is the working material of the shaped charge and is located about the fore area of the STUSC. Preferably the liner uses a copper material, but liners may be made from most any metal, ceramic, powdered metals, tungsten, silver, copper or combination of many materials.

Figure 2A:
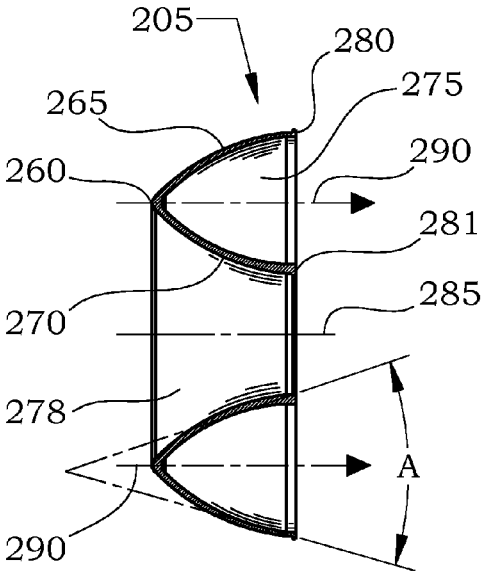
FIG. 2A is a cross-sectional view of a swept tulip profile (STUP) Liner.

The STUP liner 205, as singularly shown in FIG. 2A, has an inside wall 270, an outside wall 265, an apex 260 an outer base end 280, an inner base end 281, an outer surface that faces away from collapse axis 290, an inner surface that faces toward collapse axis 290, and an included angle A. The walls of the STUP liner 205 have a wall curvature.

For a 5 inch diameter liner of the STUSC, the inside wall 270 needs to be between 1-3 nun at the apex 260 and taper toward the inner base end 281 to between 2-5 mm. The outside wall 265 must taper the reverse direction from between 1.5-3 mm at the apex 260 and tapering down to between 1-2.5 mm at the outer base end 280. These dimensions will be refined with numerical code and experiment to give the most tailored jet to address the specific target material. Included angles for attaining the Munroe effect from two colliding walls ranges from 36 to 120 degrees. The jet velocity achieved from a shaped charge is dependent on the included angle of the liner; the narrower the angle the faster the jet but the lower the jet mass. A zero included angle (i.e., cylinder liner) can be made to jet but the jet mass is so low, the efficiency is reduced. Jet velocities can vary from 4 to 10 km/s depending on the liner material, included angle, wall thickness and other geometries.

The HE billet 215 of the STUSC device 200, located proximate the outer surface of the STUP liner 205, provides the energy to collapse the STUP liner 205, increase the ductility, and focus the flowing material causing it to jet in the shape of a hollow cylinder at very high velocity. The STUSC body 210 provides an outer mounting surface for the STUP liner 205 which is held to body 210 by outer retaining ring 255 about the outer base end 280. Body 210 also serves as a containment vessel for the delicate HE billet 215 and protects from damage or impact by supporting the outer diameter of HE billet 215. Body 210 can provide tamping for the HE billet 215 depending on body 210 thickness and density. The outer diameter of the HE billet 215 can range from about 0-25% of liner outer diameter larger than the STUP liner 205 outer diameter and still produce a proper jet. The inner diameter of the HE billet 215 can range from about 0-25% of liner inner diameter smaller than the STUP liner 105 inner diameter and still produce a proper jet. If the swept liner wall thickness and the amount of HE used are not correctly matched for the application it will result in an under driven or over driven liner, neither event will produce proper jetting. Adequate charge to mass ratios of HE to liner as per Gurney equations should be adhered to as close as the application size restrictions will allow to prevent underdriving or overdriving the liner.

The CPIC, located in the aft area of the STUSC, consists of a CPIC HE 220, charge cover 225, detonator 230, and CPIC HE cover 235. Detonator 230, located about the aft of the CPIC, provides the initial detonation impulse to the shallow cup shaped CPIC HE 220. Charge cover 225 provides a mounting cavity for detonator 230 and CPIC HE 220, and provides the critical alignment of detonator 230 with CPIC HE 220 on the symmetrical axis 285. Charge cover 225 also provides the critical alignment of CPIC HE 220 with HE billet 215, which allows for a precise ring initiation of HE billet 215. Charge cover 225 also serves to cover and protect the aft side of the HE billet 215 and maintains intimate contact of CPIC HE 220 with the HE billet 215. The CPIC function is to transform a single point initiation from detonator 230 into a ring detonation of the CPIC HE 220 that will ring initiate the aft end of the HE billet 215 which is precisely aligned with the collapse axis 290 and apex of STUP liner 205. The CPIC HE cover 235 provides a stable platform for the CPIC HE 220, houses the ESA 240, and provides a mounting structure to the aft end of the center body 245.

An explosive shock attenuator (ESA) 240 is made from a low sound velocity material and serves as a detonation wave dampener. Center body 245 supports the inner diameter of HE billet 215, provides space for ESA 240, a path for escaping detonation gases, and other devices (i.e., secondary projectile forming devices). Center body 245 provides an inner mounting surface for STUP liner 205 and aligns it with symmetrical axis 285. STUP liner 205 is held to center body 245 by inner retaining ring 250 about the liner inner base end 181. Device 200 is capable of producing a hollow cylindrical jet from the STUP liner 205 that will produce a full charge diameter or larger hole in the target.

The center body 245 is encompassed by the explosive charge or main high explosive (HE) billet and can be solid or hollow. The hollow center body 245 being an essential part of the swept profile design could contain shock attenuation materials used to dampen, reflect, and absorb shock waves that would have a detrimental effect on the formation of a stable jet. The hollow center body 245 space can also be used to contain a center projectile producing device or for adjusting HE billet quantity driving the inside wall of the liner, in addition the space can be used to relieve pressure from expanding gasses from the detonation of the HE.

Detonation wave control is very important to form stable jetting from shaped charges. Reflected shock waves can negatively affect jet formation and the overall performance of the shape charge.

The STUSC design in this embodiment has various features incorporated into it to minimize and redirect reflected shock waves. One method of control is using a hollow center body 245 that incorporates an ESA 240 made from a low sound velocity material that serves as a shock wave dampener or attenuator. The design of the outer and inner HE billet containment bodies (body 210 and center body 245) including shape, material type (i.e., powdered metal) and thickness, will both have specific designs to minimize reflected shock waves that would return and disturb jet formation. The STUSC devices can use cast, pressed, extruded, or even hand packed HE from any high quality explosive that is capable of 4-10 km/s detonation rate.

Initiation of a STUSC detonation requires a two stage initiation process that accurately aligns the detonation wave with the STUP liner 205. This accuracy is obtained by first coupling a single point detonation from a detonator that initiates the CPIC HE 220 that is in the shape of a shallow circular cup which forms a non-broken simultaneous ring detonation. During the second stage of initiation, the simultaneous detonation ring from the CPIC HE 220 initiates detonation at the aft end of the main HE billet 215. The diameter of the ring initiation of the main HE billet 215 is critical to obtain the desired direction of jet projection and must be tailored to each liner design.

As the ring detonation wave travels through the HE billet 215, the pressures created on the liner walls (265 and 270) cause them to collapse and converge onto the collapse axis 290 forming the hollow cylindrical jet wall. As this process continues, the jetting material forms a stretching hollow cylinder jet with its median diameter equal to the diameter of the apex of the STUP liner 205.

FIG. 2A shows STUP liner 205 that is used in device 200 of FIG. 2. The STUP liner 205 consist of an outer base end 280, outside wall 265, apex 260, inner base end 281, inside wall 270, axis of symmetry 285, collapse axis 290, an outer surface 278, an inner surface 275, and included angle A. Collapse axis 290 is shown parallel to the axis of symmetry 285, but can be almost any angle relative to the axis of symmetry 285 that would represent a converging or diverging jet trajectory formed by the detonation wave and STUP liner 205. The arched walls of the STUP liner 205 can outperform the straight walls of a conical liner since the arc of the liner walls tends to reduce the included angle A from apex 260 to the inner base end 281 and outer base end 208. The radius of arched STUP liner 205 walls can be increased or decreased to obtain desired jet velocity, length and mass. Outside wall 265 has on outward concave curvature relative to symmetrical axis 285 and inside wall 270 has an inward convex curvature relative to symmetrical axis 285. Compared to planer wall liners the STUP liner 205 design reduces the jet stretch rate by speeding up the aft end or tail of the jet making the jet shorter more robust and perform better at longer target standoff.

The thickness of inside wall 270 gradually increases from the apex 260 to the inner base end 281, and the thickness of outside wall 265 gradually decreases from apex 260 to the outer base end 280. The wall thickness is varied in this way to balance the explosive charge to STUP liner 205 mass ratios, which also balances the momentum of the collapse of the STUP liner 205 walls. Liner wall momentum balancing will insure that inside wall 270 and outside wall 265 will meet at the collapse axis 290 in concert to produce stable jetting. STUP liners can be challenging to balance since the mass of the outer wall 270 increases as the diameter increases from apex 260 to base end 280 and the mass of the inner wall 265 decreases as the diameter decreases from apex 260 to base end 281.

Liner thickness of shaped charges are dependent on the overall diameter of the device, the liner wall should increase in thickness as the device diameter increases and decrease in thickness as the device diameter decreases. Shaped charges scale very nicely and for the person skilled in this craft making this device in any size would be evident based on the information given. Shaped charges by their very nature have varying wall thicknesses and profiles depending on material, density, and desired effect on a target.

For example, a 5 inch diameter liner of the STUSC the inside wall needs to be between 1-3 mm at the apex and taper toward the base end to between 2-5 mm. The outside wall must taper the reverse direction from between 1.5-3 mm at the apex and tapering down to between 1-2.5 mm at the base. These dimensions will be refined with numerical code and experiment to give the most tailored jet to address the specific target material.

The outside wall 265 and inside wall 270 of STUP liner 205 are set at an included angle A that can be changed to produce desired jetting characteristics (i.e., jet mass, and velocity). STUP liners require approximately a 30-120 degree included angle A between the outside wall 265 and inside wall 270 for optimum jetting. Greater included angles shorten the length of the STUP liner 205 along the axis of symmetry 285 and shortens the length of the inside wall 270 and outside wall 265, this shortening forces the diameter and mass of the outside wall 265 to increase at a higher rate from apex 260 to outer base end 280, inversely the inside wall 270 decreases at a higher rate in diameter and mass from apex 260 to inner base end 281. The included angle A and mass distribution of the inside wall 270 and outside wall 265 must be tailored to each other to produce a straight axisymmetric hollow cylindrical jet on collapse axis 290, that projects in the direction of the collapse axis 290 arrow and is parallel with symmetrical axis 285 of the SCP liner 205.

Detonation pressures from the explosive collapse of the STUP liner 205 outside wall 265 moving it into a smaller volume thusly increasing its bulk density and velocity, while being driven toward the collapse axis 290. At the same time the STUP liner 205 inside wall 270 is driven toward collapse axis 290 by the explosive; the inside wall 270 driven material is moved, decreasing in bulk density and velocity due to an increase in diameter as it moves toward the collapse axis 290. This process further explains the important and tedious task of momentum balancing the high velocity collapsing STUP liner 205 walls in order to produce a viable hollow cylindrical jet.

Figure 2B:
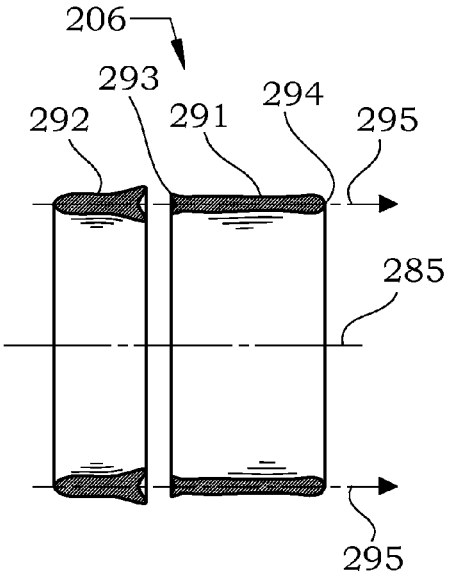
FIG. 2B is a cross-sectional view of a jet formed from a STUSC.

FIG. 2B is a cross-sectional view of a typical hollow cylindrical projectile (HCP) 206 produced by a STUSC. The HCP 206 consist of a jet 291, slug 292, jet tail 293, jet tip 294, projection axis 295, and symmetrical axis 285. Jet 291 and slug 292 velocities, angle of projection, thickness, length and inside diameter can vary depending on the design of the STUSC. This depiction of HCP 206 is at a finite time after the detonation of a STUSC. The HCP 206 at an earlier time frame after detonation would show the jet 291 and slug 292 shorter in length and possible still connected. At a later time frame, jet 291 and slug 292 would become longer, thinner and further separated because of the ductile stretching of the HCP material. The projection axis 295 is shown parallel to symmetrical axis 285 but could be almost any angle either converging or diverging depending on the STUSC design and intended use.

The trumpet (not shown) and the tulip swept liner designs both have inner and outer liner wall curvatures but the direction of curvatures are opposite. A trumpet liner has outside wall 265 and inside wall 270 convex to the collapse axis 290. Whereas a tulip liner outside wall 265 and inside wall 270 is concave to the collapse axis 290.

The STUSC is balancing the momentums of the collapsing inner and outer liner walls producing a large diameter stable projectile that will remove the full diameter or larger of target material creating a hole without leaving behind a center core. If the momentums of a STUSC are not matched correctly the jet will not follow the desired trajectory, be of insufficient mass for desired target penetration or not form at all.

Figure 3:
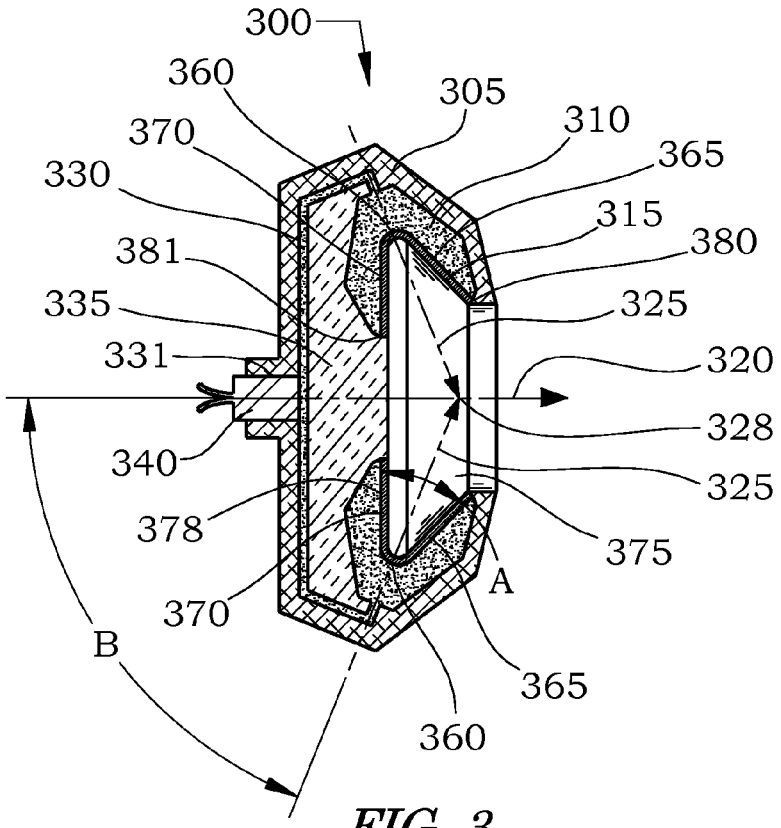
FIG. 3 is a cross-sectional view of a swept converging conical shaped charge device (SCCSC).

Device 300 in FIG. 3 is a swept converging conical shaped charge device (SCCSC), having an aft area and a fore area, and consists of a swept converging conical profile (SCCP) liner 315, a body 305, a high explosive (HE) billet 310 which is a mass of high explosive, and a peripheral initiation (PI) HE 330, all components of device 300 share a common symmetrical axis 320.

The SCCP liner 315 is the working material of the shaped charge and is located about the fore area of the SCCSC. Preferably the liner uses a copper material, but liners may be made from most any metal, ceramic, powdered metals, tungsten, silver, copper or combination of many materials.

The SCCP liner 315 has an inside wall 370, an outside wall 365, an apex 360 an outer base end 380, an inner base end 381, an outer surface 378, an inner surface 375, and an included angle A. Liner thickness of shaped charges are dependent on the overall diameter of the device, the liner wall should increase in thickness as the device diameter increases and decrease in thickness as the device diameter decreases. Shaped charges scale very nicely and for the person skilled in this craft making this device in any size would be evident based on the information given. Shaped charges by their very nature have varying wall thicknesses and profiles depending on material, density, and desired effect on a target.

For a 5 inch diameter liner of the SCCSC, the inside wall 370 needs to be between 1-3 mm at the apex 360 and taper toward the inner base end 381 to between 2-5 mm. The outside wall 365 must taper the reverse direction from between 1.5-3 mm at the apex 360 and tapering down to between 1-2.5 mm at the outer base end 380. These dimensions will be refined with numerical code and experiment to give the most tailored jet to address the specific target material.

Included angles for attaining the Munroe effect from two colliding walls ranges from 36 to 120 degrees. The jet velocity achieved from a shaped charge is dependent on the included angle of the liner; the narrower the angle the faster the jet but the lower the jet mass. A zero included angle (i.e., cylinder liner) can be made to jet but the jet mass is so low, the efficiency is reduced. Jet velocities can vary from 4 to 10 km/s depending on the liner material, included angle, wall thickness and other geometries.

The HE billet 310 of the SCCSC device 200, located proximate the outer surface 378 of the SCCP liner 315, provides the energy to collapse the SCCP liner 315, increase the ductility of the SCCP liner 315, and focus the flowing material causing it to jet in the shape of a hollow cone at very high velocity. The SCCSC body 305 provides an outer mounting surface for the SCCP liner 315 about the outer base end 380. Body 305 also serves as a containment vessel for the delicate HE billet 310 and protect from damage or impact by supporting the outer diameter of HE billet 310. Body 305 can provide tamping for the HE billet 310 depending on body 305 thickness and density. The outer diameter of the HE billet 315 can range from about 0-25% of liner outer diameter larger than the SCCP liner 305 outer diameter and still produce a proper jet. The inner diameter of the HE billet 315 can range from about 0-25% of liner inner diameter smaller than the SCCP liner 305 inner diameter and still produce a proper jet. If the swept liner wall thickness and the amount of HE used are not correctly matched for the application it will result in an under driven or over driven liner, neither event will produce proper jetting. Adequate charge to mass ratios of HE to liner as per Gurney equations should be adhered to as close as the application size restrictions will allow to prevent underdriving or overdriving the liner.

Detonator 340 provides the initial detonation impulse to the shallow cup shaped peripheral initiation (PI) HE 330. Body 305 provides a mounting cavity 331 for detonator 340 and PI HE 330, and provides the critical alignment of detonator 340 with PI HE 330 on the symmetrical axis 320. Body 305 also provides the critical alignment of PI HE 330 with HE billet 310, which allows for a precise ring initiation of HE billet 310. Body 305 also serves to cover and protect the HE billet 310 and maintains intimate contact of PI HE 330 with the HE billet 310. The PI HE 330 function is to transform a single point initiation from detonator 340 into a ring detonation of the PI HE 330 that will ring initiate the aft end of the HE billet 310 which is precisely aligned with the collapse axis 325 and apex 360 of SCCP liner 315. The PI HE 330 is isolated from HE billet 310 and held in place by inner body 335. Inner body 335 can be made from a combination of low sound velocity materials and serves as a detonation wave dampener and HE billet support structure.

This converging version of the swept profile concept can produce an Ultra High Speed Jet. The jetting trajectory from a SCCP liner 315 is represented by collapse axis 325 which is converging at Angle B toward the device symmetrical axis 320 in the direction of the collapse axis 325 at focal point 328. Angle B will be greater than zero degrees and smaller than 90 degrees. The gain in jet velocity is accomplished by forcing the SCCP liner 315 material to go through a double convergence. The first convergence is on collapse axis 325 and is a process similar to the ACLSC device embodiment described in FIG. 1 and would be peripherally initiated by PI HE 330 or a CPIC as described in FIG. 1 by detonator 340. The second convergence happens at a focal point 328 on symmetrical axis 320 where the material of the hollow jet formed during the first convergence goes through a second velocity increasing convergence resulting in a smaller diameter ultra-high speed jet.

The SCCSC design in this embodiment has various features incorporated into it to minimize and redirect reflected shock waves. The design of the HE billet 310 containment bodies (body 305 and inner body 335) including shape, material type (i.e., powdered metal) and thickness, will have specific designs to minimize reflected shock waves that would return and disturb jet formation. The SCCSC devices can use cast, pressed, extruded, or even hand packed HE from any high quality explosive that is capable of 4-10 km/s detonation rate.

Initiation of a SCCSC detonation requires a two stage initiation process that accurately aligns the detonation wave with the SCCP liner 315. This accuracy is obtained by first coupling a single point detonation from a detonator that initiates the PI HE 330 that is in the shape of a shallow circular cup which forms a non-broken simultaneous ring detonation. During the second stage of initiation, the simultaneous detonation ring from the PI HE 330 initiates detonation at the aft end of the main HE billet 310. The diameter of the ring initiation of the main HE billet 310 is critical to obtain the desired direction of jet projection and must be tailored to each liner design.

As the ring detonation wave travels through the HE billet 310, the pressures created on the liner walls (365 and 370) cause them to collapse and converge onto a collapse axis 325 forming the hollow cone jet wall. As this process continues, the jetting material of the hollow cone jet converges to a focal point 328 to form a smaller diameter ultra-high speed rod jet.

Figure 3A:
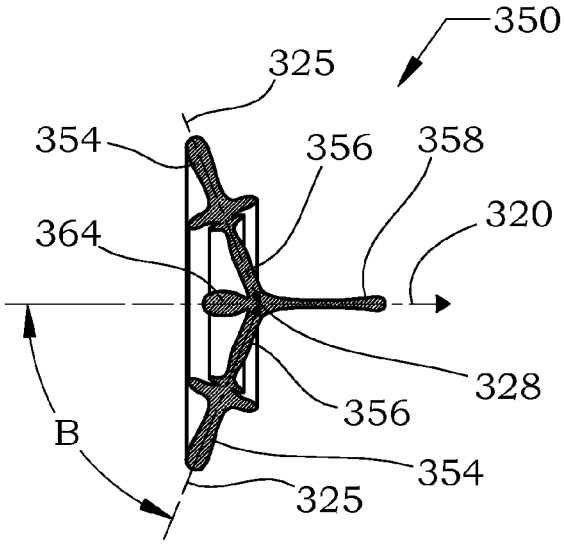
FIG. 3A is a cross-sectional view of a jet formed from an SCCSC.

FIG. 3A is a Cascading jet 350 formed by SCCSC 300 in FIG. 3 and consists of a primary slug 354, primary jet 356, secondary slug 364, secondary jet 358, focal point 328, symmetrical axis 320, and collapse axis 325. The primary jet 356 is shaped like a hollow cone with a trajectory represented by collapse axis 325. An optimum convergence Angle B between the symmetrical axis 320 and collapse axis 325 (greater than zero degrees and smaller than 90 degrees) will produce the maximum velocity and mass secondary jet 358 with the smallest amount of secondary slug 364. The gain in secondary jet 358 velocity is accomplished by the secondary convergence of the primary jet 356 material at focal point 328. The first convergence of liner material is on collapse axis 325 and is a process similar to the ACLSC device described in this embodiment. The second convergence at a focal point 328 on symmetrical axis 320 is where the material of the hollow cone primary jet 356 formed during the first convergence goes through a second velocity increasing convergence resulting in a smaller diameter ultra-high speed rod jet 358.

The SCCSC device produces a ultra-high speed rod jet that exceeds previously attained shaped charge jet velocities.

The invention claimed is:

1. An axisymmetric circular linear shaped charge device, comprising:

a liner configured in a partial toroid with a longitudinal axis intersecting an aperture located near the center of said partial toroid, said partial toroid being open-ended on a plane that intersects said longitudinal axis in a perpendicular manner toward a front end of the shaped charge device, said liner having a hollow conical cross-section extending toward a closed end of the partial toroid as defined by a longitudinal plane that is aligned on said longitudinal axis and an apex of said conical cross-section at a closed end of the partial toroid that extends toward a rear end of said shaped charge device, said liner having an outer surface and an inner surface, said inner surface exposed toward the open end of the front end of the shaped charge device and said liner producing an explosive hollow cylindrical jet stream directed toward said front of said shaped charge device upon detonation of the shaped charge device;

a billet of high explosive material having a front end and a rear end located behind and proximate to the outer surface of said liner, said billet configured as a toroid with an internal aperture located proximate to the aperture of the liner, and said billet producing a high explosive detonation effect applied to said liner to produce said hollow cylindrical jet stream;

a coupler located in a rear portion of the shaped charge device, said coupler coupled to the rear end of the billet and said coupler producing a detonation wave initiating the high explosive detonation effect of the billet; and a body located around the outer surface of the billet and extending longitudinally the length of the billet, said body having a front end secured to said liner and, said body having a rear end secured to the coupler.

2. The shaped charge of claim 1, further comprising:
an attenuator located proximate to the aperture in the billet, said attenuator dampening a detonation wave.

3. The shaped charge of claim 1, wherein said coupler initiates a ring initiation at the rear end of the billet to produce the detonation wave and initiate the high explosive detonation effect of the billet.

4. The shaped charge of claim 1, wherein the coupler provides the critical alignment of the detonator with the coupler high explosive on the longitudinal axis of the shaped charge and provides the critical alignment of the coupler high explosive with the billet which to allow for a precise ring initiation of the billet.

5. The shaped charge of claim 1, further comprising:
a center body located proximate to the aperture of said liner and rearward of the billet toward the rear portion of the shaped charge device.

6. The shaped charge of claim 5, wherein the center body is hollow and provides a space for shock attenuation materials used to dampen shock waves.

7. The shaped charge of claim 6, wherein the space within the hollow center body can be used to contain a center projectile producing device.

8. An axisymmetric circular linear shaped charge device, comprising:
a liner configured in a partial toroid with a longitudinal axis intersecting an aperture located near the center of said partial toroid, said partial toroid being open-ended on a plane that intersects said longitudinal axis in a perpendicular manner toward a front end of the shaped charge device, said liner having a hollow conical cross-section extending toward a closed end of the partial toroid as defined by a longitudinal plane that is aligned on said longitudinal axis and an apex of said conical cross-section at a closed end of the partial toroid that extends toward a rear end of said shaped charge device, said liner having an outer surface and an inner surface, said inner surface exposed toward the open end of the front end of the shaped charge device and said liner producing an explosive hollow cylindrical jet stream directed toward said front of said shaped charge device upon detonation of the shaped charge device;
a billet of high explosive material having a front end and a rear end located behind and proximate to the outer surface of said liner, said billet configured as a toroid with an internal aperture located proximate to the aperture of the liner, and said billet producing a high explosive detonation effect applied to said liner to produce said hollow cylindrical jet stream;
a coupler located in a rear portion of the shaped charge device, said coupler coupled to the rear end of the billet and said coupler producing a detonation wave initiating the high explosive detonation effect of the billet;
a body located around the outer surface of the billet and extending longitudinally the length of the billet, said body having a front end secured to said liner and, said body having a rear end secured to the coupler; and
said shaped charge device producing an explosive hollow cylindrical jet upon detonation of said shaped charge device, said hollow cylindrical jet forming a hole in a target material that is wider than the outer diameter of the shaped charge device.

9. The shaped charge of claim 8, further comprising:
an attenuator located proximate to the aperture in the billet, said attenuator dampening a detonation wave.

10. The shaped charge of claim 8, wherein said coupler initiates a ring initiation at the rear end of the billet to produce the detonation wave and initiate the high explosive detonation effect of the billet.

11. The shaped charge of claim 8, wherein the coupler provides the critical alignment of the detonator with the coupler high explosive on the longitudinal axis of the shaped charge and provides the critical alignment of the coupler high explosive with the billet which to allow for a precise ring initiation of the billet.

12. The shaped charge of claim 8, further comprising:
a center body located proximate to the aperture of said liner and rearward of the billet toward the rear portion of the shaped charge device.

13. The shaped charge of claim 12, wherein the center body is hollow and provides a space for shock attenuation materials used to dampen shock waves.

14. The shaped charge of claim 13, wherein the space within the hollow center body can be used to contain a center projectile producing device.

15. A method of producing an axisymmetric cylindrical jet stream from a circular linear shaped charge device, comprising the steps of:
providing a liner configured in a partial toroid with a longitudinal axis intersecting an aperture located near the center of said partial toroid, said partial toroid being open-ended on a plane that intersects said longitudinal axis in a perpendicular manner toward a front end of the shaped charge device, said liner having a hollow conical cross-section extending toward a closed end of the partial toroid as defined by a longitudinal plane that is aligned on said longitudinal axis and an apex of said conical cross-section at a closed end of the partial toroid that extends toward a rear end of said shaped charge device, said liner having an outer surface and an inner surface, said inner surface exposed toward the open end of the front end of the shaped charge device;
positioning a billet of high explosive material behind and proximate to the outer surface of said liner, said billet being proximate to the aperture of the liner, and said billet producing a high explosive detonation effect applied to said liner to produce said hollow cylindrical jet stream;
positioning a coupler at a rear portion of the shaped charge device in contact with the rear of the billet, said coupler producing a detonation wave and initiating the high explosive detonation effect of the billet;
surrounding the shaped charge device with a body around the outer diameter of the billet and extending longitudinally the length of the billet; and
producing an explosive hollow cylindrical jet stream with the liner that is directed toward said front of said shaped charge device upon detonation of the shaped charge device.

16. The method of claim 15, further comprising the step of:
providing an attenuator proximate to the aperture in the billet, said attenuator dampening a detonation wave.

17. The method of claim 15, wherein said coupler initiates a ring initiation at the rear end of the billet to produce the detonation wave and initiate the high explosive detonation effect of the billet.

18. The method of claim 15, wherein the coupler provides the critical alignment of the detonator with the coupler high explosive on the longitudinal axis of the shaped charge and provides the critical alignment of the coupler high explosive with the billet which to allow for a precise ring initiation of the billet.

19. The method of claim 15, further comprising the step of: positioning a center body proximate to the aperture of said liner and rearward of the billet toward the rear portion of the shaped charge device.

20. The method of claim 19, wherein the center body is hollow and provides a space for shock attenuation materials used to dampen shock waves.

21. The method of claim 20, wherein the space within the hollow center body can be used to contain a center projectile producing device.

22. The method of claim 15, further comprising the step of: producing an explosive hollow cylindrical jet upon detonation of said shaped charge device, said hollow cylindrical jet forming a hole in a target material that is wider than the outer diameter of the shaped charge device.

* * * * *

UNITED STATES PATENT AND TRADEMARK OFFICE

CERTIFICATE OF CORRECTION

PATENT NO. : 9,175,936 B1
APPLICATION NO. : 14/181223
DATED : November 3, 2015
INVENTOR(S) : Nicholas Collier It is certified that error appears in the above-identified patent and that said Letters Patent is hereby corrected as shown below:

IN THE CLAIMS

Claim 11, line 5 (Col. 18, line 9), delete "which"
Claim 18, line 5 (Col. 18, line 66), delete "which"

Signed and Sealed this
Twenty-ninth Day of March, 2016

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 9,175,936 B1
APPLICATION NO. : 14/181223
DATED : November 3, 2015
INVENTOR(S) : Nicholas Collier It is certified that error appears in the above-identified patent and that said Letters Patent is hereby corrected as shown below:

In the Claims

Claim 4, line 5 (Col. 17, line 12), delete "which"

Signed and Sealed this
Twenty-fourth Day of May, 2016

Michelle K. Lee

Michelle K. Lee
*Director of the United States Patent and Trademark Office*